United States Patent [19]

Day et al.

[11] Patent Number: 4,543,658

[45] Date of Patent: Sep. 24, 1985

[54] SHEET SEPARATING DEVICE FOR A SHEET COUNTING APPARATUS

[75] Inventors: George W. Day, Dovercourt; Kenneth G. Dalby, Clacton-on-Sea, both of United Kingdom

[73] Assignee: Vacuumatic Limited, Harwich, United Kingdom

[21] Appl. No.: 425,791

[22] Filed: Sep. 28, 1982

[30] Foreign Application Priority Data

Oct. 1, 1981 [GB] United Kingdom ..... 8129664

[51] Int. Cl.[4] ..... G06M 9/02

[52] U.S. Cl. ..... 377/8

[58] Field of Search ..... 377/8

[56] References Cited

U.S. PATENT DOCUMENTS 3,962,564 6/1976 Dutton ..... 377/8

FOREIGN PATENT DOCUMENTS 1346749 of 1974 United Kingdom ..... 377/8
1426523 of 1976 United Kingdom ..... 377/8
667980 of 1977 U.S.S.R. ..... 377/8

*Primary Examiner*—John S. Heyman
*Assistant Examiner*—K. Ohralik
*Attorney, Agent, or Firm*—Beveridge, DeGrandi and Weilacher

[57] ABSTRACT

The disclosure relates to sheet separating device for a stack counting apparatus including a counting head to traverse a corner of a stack and having a horizontal suction blade with a suction orifice on its upper surface for insertion in the stack and oscillatable about a horizontal axis to separate a corner of a sheet in the stack adhered by the suction port to the blade from the next sheet. A wiping pin is driven in an elongate orbit around the blade from the trailing edge thereof over the upper surface to the leading edge and along the underside of the blade to transfer a corner of a sheet adhered to the upper surface of the blade from the upper surface to the lower surface. A counting device is arranged to count the number of sheets transferred by the pin. In order to minimize damage to the stack by the engagement of the blade and pin in the stack, the path of the movement of the pin from the upper surface to the lower surface adjacent the leading edge of the blade is in a generally vertical direction after which the pin moves generally horizontally close to the underside of the blade, while the blade remains substantially horizontal and the blade tilts downwards to separate the corner of a sheet on it from the sheet above only after the pin has moved beyond the undersurface of the blade. The pin then moves over the upper side of the blade towards the leading edge thereof as the blade returns to the horizontal.

10 Claims, 29 Drawing Figures

SHEET SEPARATING DEVICE FOR A SHEET COUNTING APPARATUS

BACKGROUND OF THE INVENTION

1. Field of the Invention

This invention relates to a sheet separating device for use, for example in a sheet counting apparatus.

2. Description of the Prior Art

A sheet separating device for use in apparatus for counting a stack of sheets comprising a counting head which in use is traversed along a corner of the stack and has a separating device comprising a suction blade provided with a suction orifice for insertion in the corner of the stack, which blade is oscillatable about a horizontal axis to separate a corner of a sheet in the stack adhered by suction to one side of the blade from the next sheet, and a wiping pin movable in an elongate orbit around the blade to transfer the corner of the sheet from one side of the blade to the opposite side thereof together with means to count the number of transfer operations effected.

U.K. Patent Specification Nos. 1346749, 1426523, 1455108, 1455109 and 1455110 all describe and illustrate examples of such counting machines. The blade/pin movements of all the arrangements shown in these specifications force a wide separation angle between adjacent sheets in the stack which tends to cause damage to the sheets particularly when counting thicker sheets which tend to be permanently creased as a result of the action of the pin/blade in the corner of the stack.

It is an object of this invention to provide a sheet separating device for use in a sheet counting machine in which damage to the sheets as a result of the action of the blade/pin in the stack is avoided or minimised.

SUMMARY OF THE INVENTION

The invention provides a sheet separating device for a sheet counting apparatus comprising, a horizontally extending blade having a leading edge for insertion in a corner of a stack of sheets and a trailing edge, means to rotate the blade between a horizontal attitude and a position in which the blade is downwardly inclined towards the trailing edge thereof, suction means on the upper side of the blade, to adhere a corner of a sheet to the upper side of the blade, a wiper pin extending parallel to the blade and means to move the pin in an orbit around the blade from the trailing edge thereof over the upper surface to the leading edge and along the underside of the blade to transfer a corner of a sheet adhered to the upper surface of the blade by said suction means from the upper surface to the lower surface, the path of movement of the pin from the upper surface to the lower surface adjacent the leading edge of the blade being in a generally vertical direction after which the pin moves generally horizontally close to the under side of the blade whilst the latter remains substantially horizontal, the blade tilting downards after the pin has moved beyond its under-surface and the pin then moving over the upper side of the blade towards the leading edge thereof as the blade returns to the horizontal.

Since the pin moves out of the stack horizontally immediately below the blade when the latter is also horizontal, the deflection of the stack and therefore damage to the stack is minimised.

BRIEF DESCRIPTION OF THE DRAWINGS

The following is a description of a specific embodiment of the invention, reference being made to the accompanying drawing in which.

DESCRIPTION OF THE PREFERRED EMBODIMENT

The drawings illustrate a sheet separating device for an apparatus for counting a vertical stack of sheets comprising a vertically extending mechanism on which the sheet separating device is mounted and is traversed up a corner of the stack to separate one by one and to count the sheets of the stack. The mechanism for supporting and traversing the sheet separating device up the corner of the stack and for counting the separated sheets is generally as described and illustrated in our U.K. Pat. No. 1426523 to which reference should be made. The mechanism for actually separating corners of individual sheets in the stack as part of the counting operation will now be described in detail with reference to the drawings.

Figure 2:
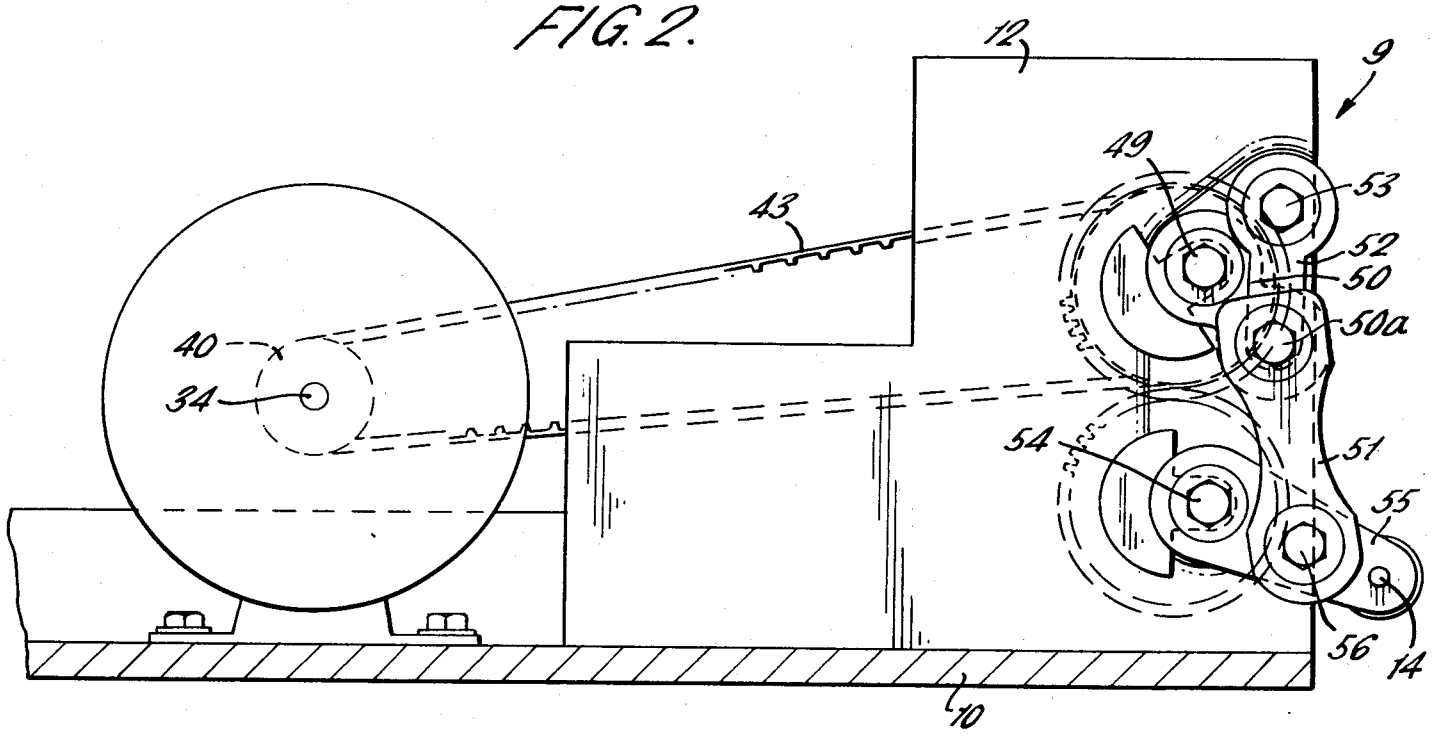
FIG. 2 is a section on the line 2—2 of FIG. 1.
Figure 3:
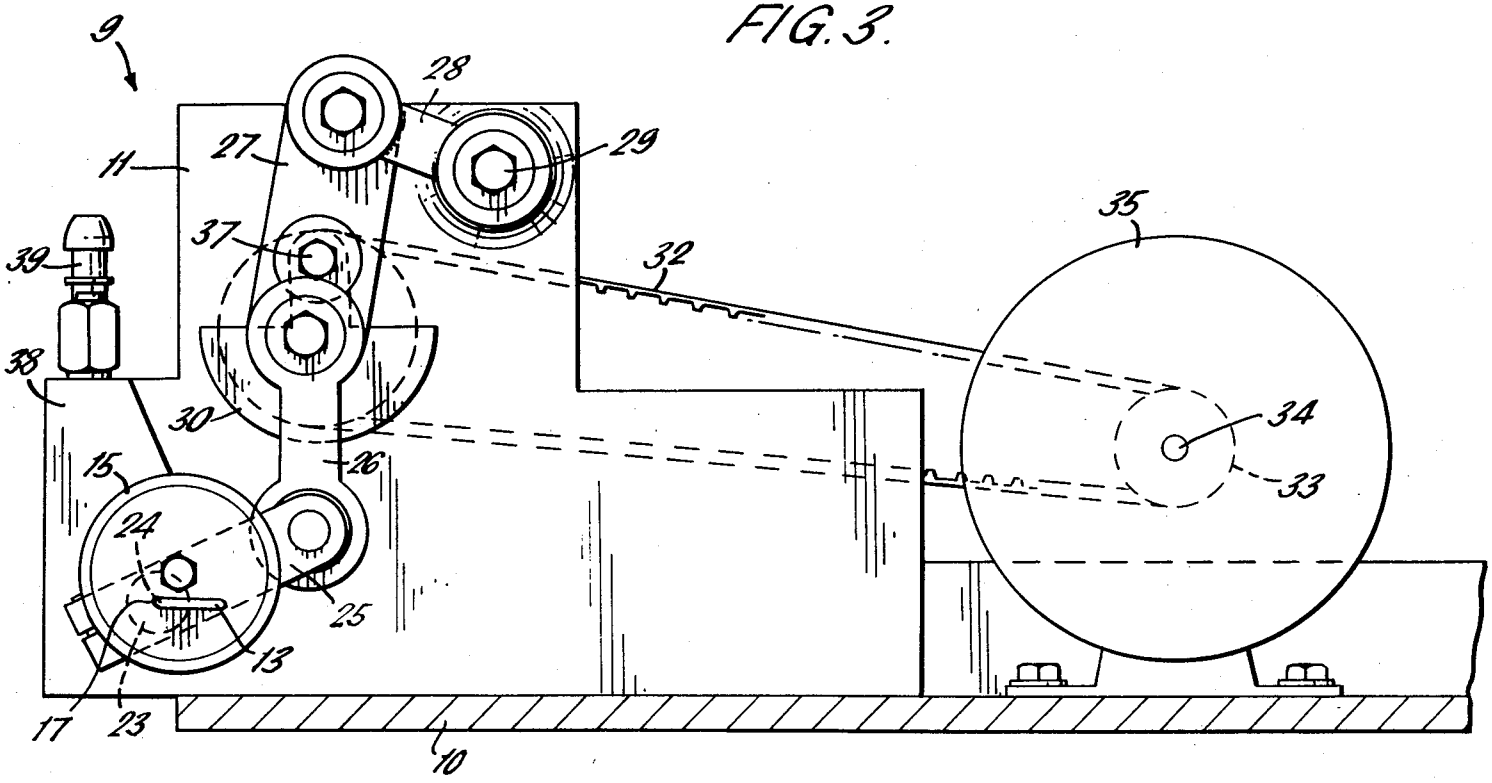
FIG. 3 is a section on the line 3—3 of FIG. 1.
Figure 4:
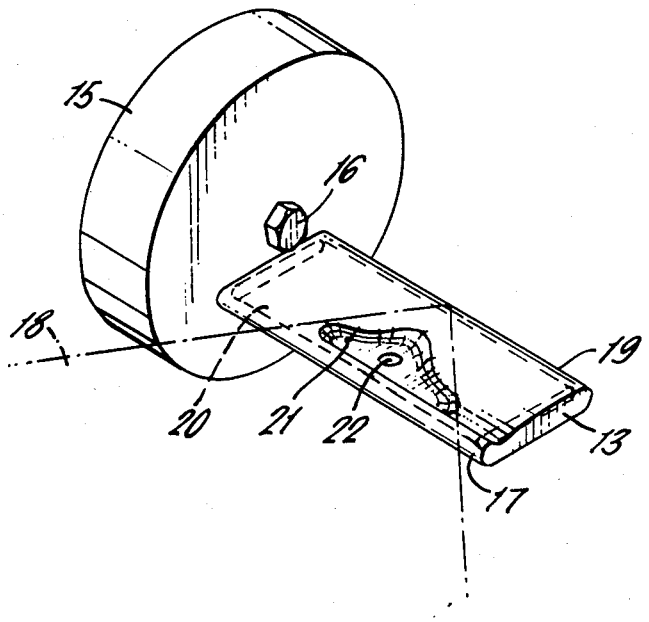
FIG. 4 is a detailed view of a suction blade of the separating device.

The separating device comprises a generally rectangular base 10 having upstanding side walls 11, 12 extending parallel to one another along the sides of the base. The front end indicated generally at 9 on FIGS. 2 and 3 lies immediately adjacent to the corner of the stack to be counted in use and a horizontally extending blade 13 is mounted on the side wall 11 to engage in the corner of the stack and a parallel pin 14 is mounted on the side wall 12 to pass sheets one after another from one side of the blade to the other. Referring to FIG. 4 of the drawings, the blade 13 is shown in greater detail and, as can be seen, is mounted in cantilever fashion on a drum 15 by means of a fixing bolt 16.

The blade 13 has a leading edge 17 which extends into a corner of the stack of sheets to be counted as indicated in chain line at 18. The trailing edge of the blade is indicated at 19. The blade is a flattened tube having a cavity 20 therein which communicates through the drum with a source of vacuum (not shown). At the centre of the blade adjacent the leading edge thereof, there is a generally triangular shaped recess 21 in the upper surface of the blade and a suction hole 22 is formed in the bottom of the recess opening into the cavity 20. Suction force at the hole 22 causes a corner of a sheet of the stack above the blade 13 to be adhered to the top surface of the blade.

Figure 5:
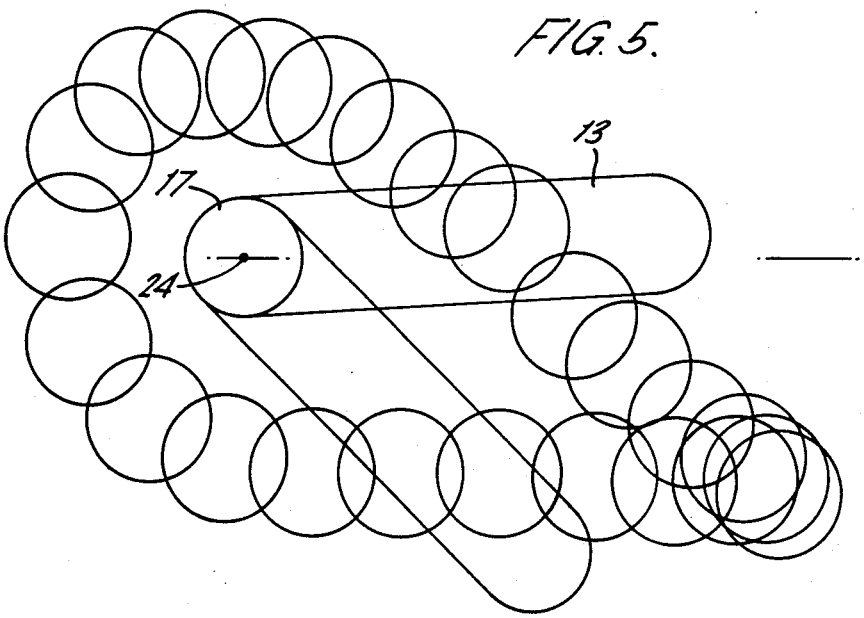
FIG. 5 shows the complete orbit of the wiper pin around the suction blade in 15° steps and also shows the movement of the suction blade.
Figure 6:
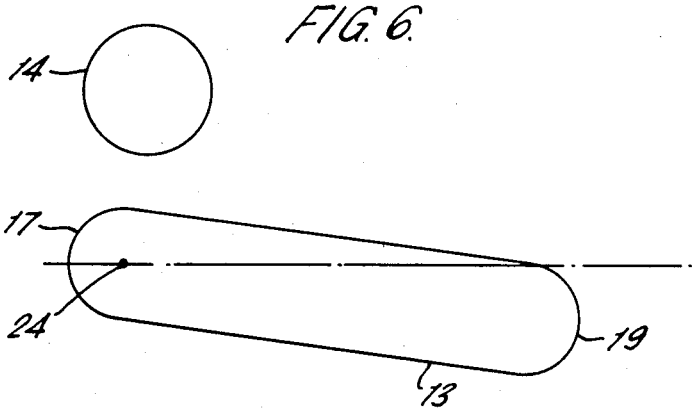
FIGS. 6 to 29 show step by step movement of the pin and suction blade in 15° steps of the cycle.
Figure 7:
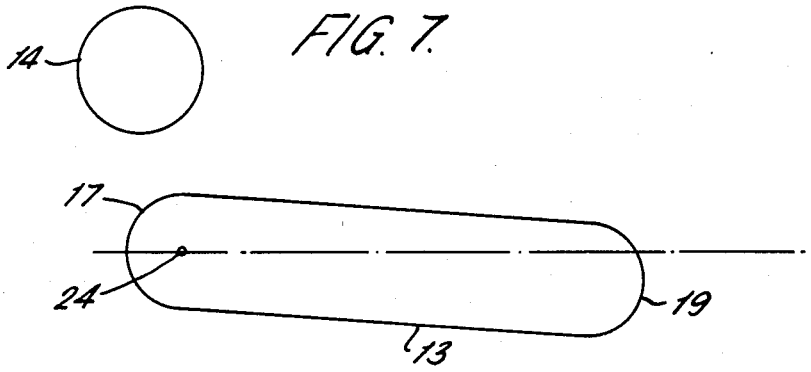
Figure 8:
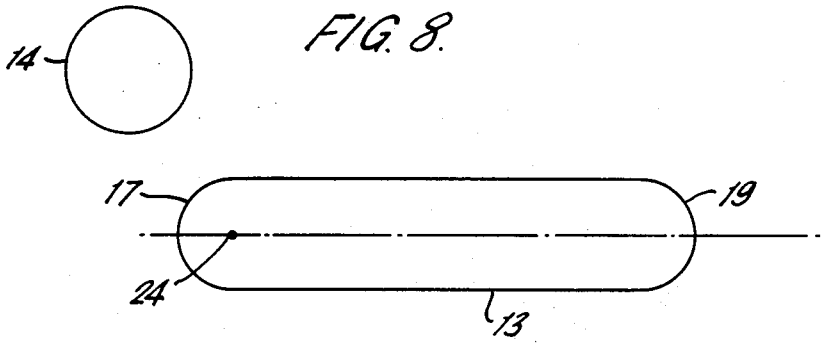
Figure 9:
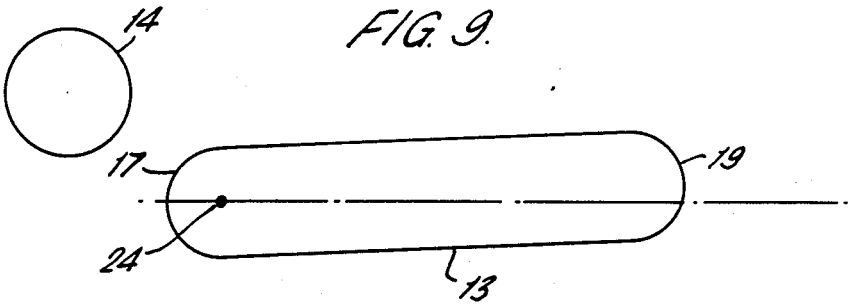
Figure 10:
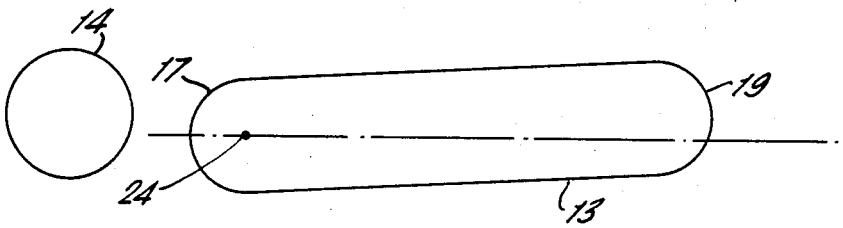
Figure 11:
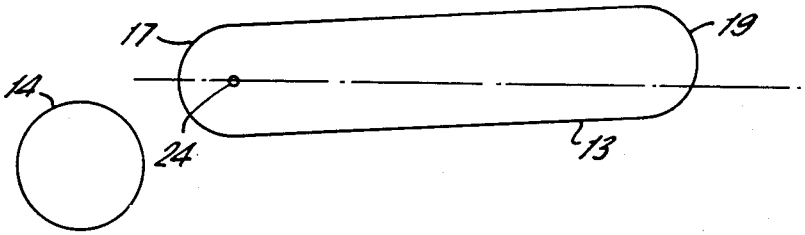
Figure 12:
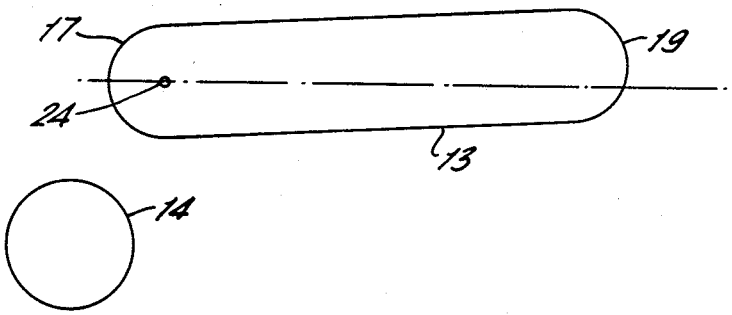
Figure 13:
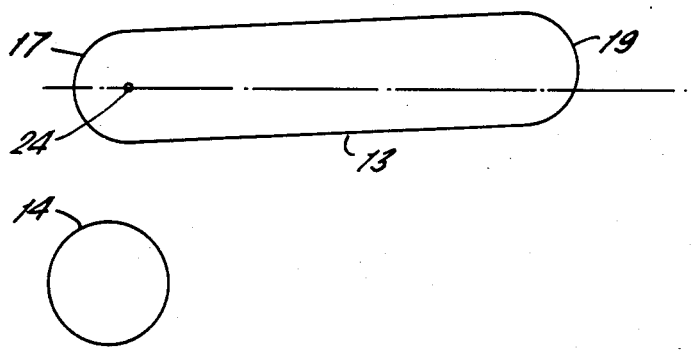
Figure 14:
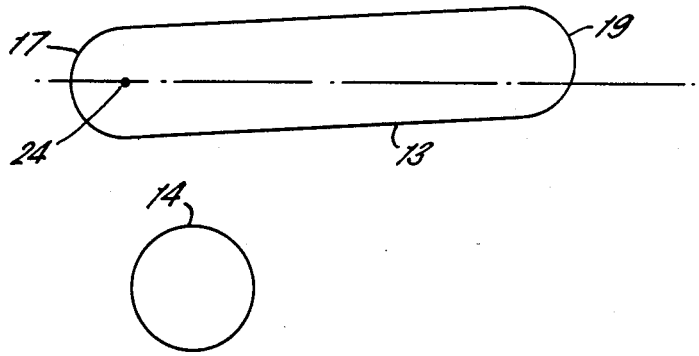
Figure 15:
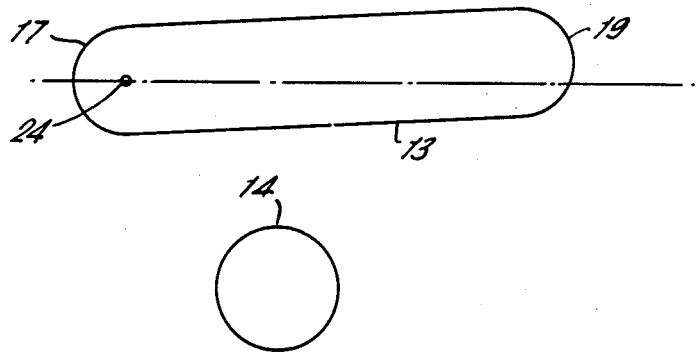
Figure 16:
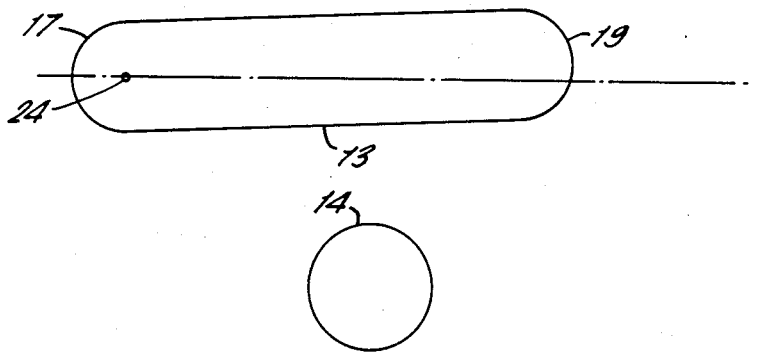
Figure 17:
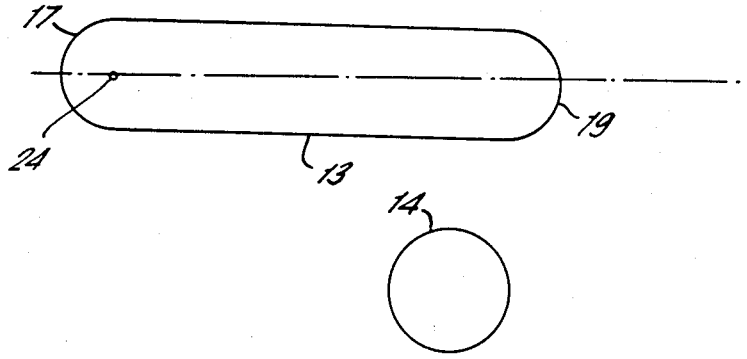
Figure 18:
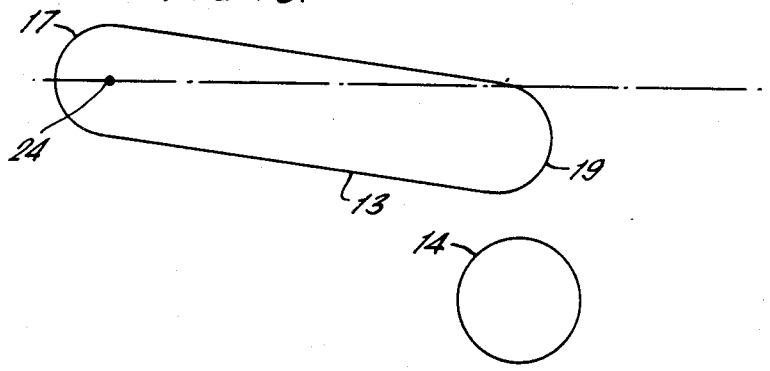
Figure 19:
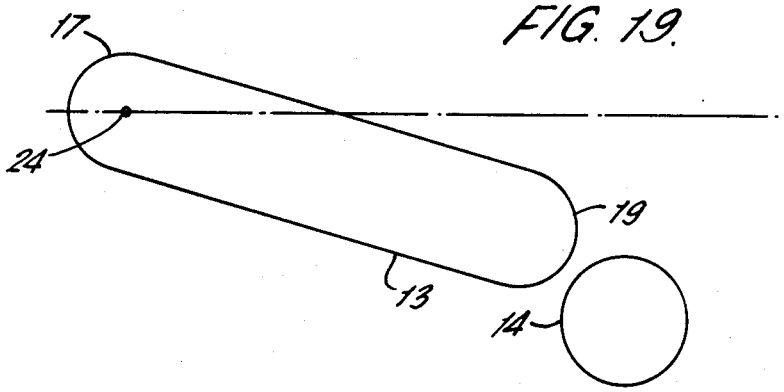
Figure 20:
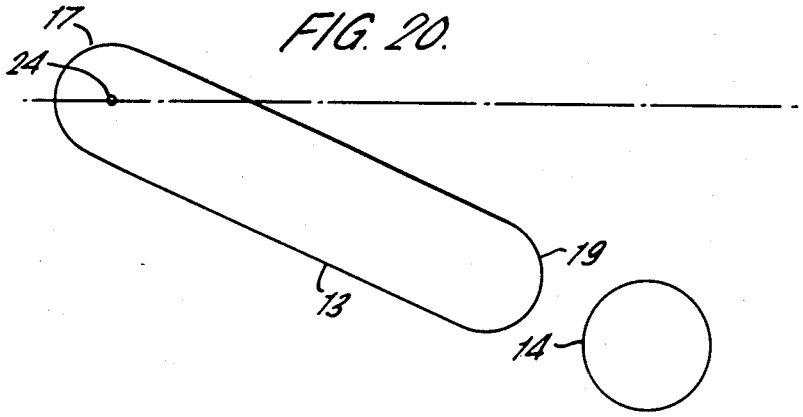
Figure 21:
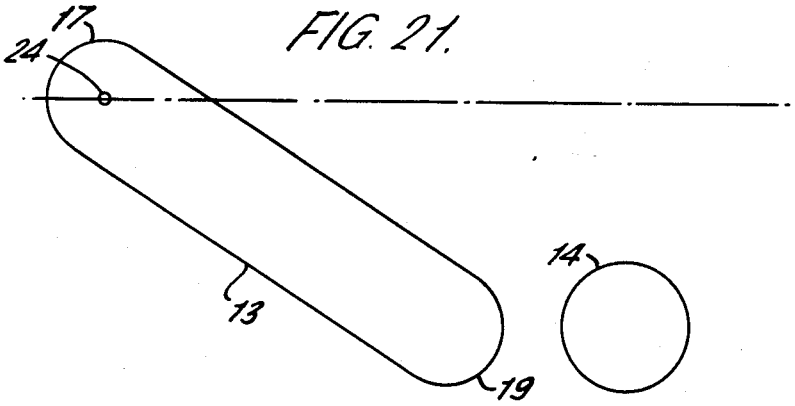
Figure 22:
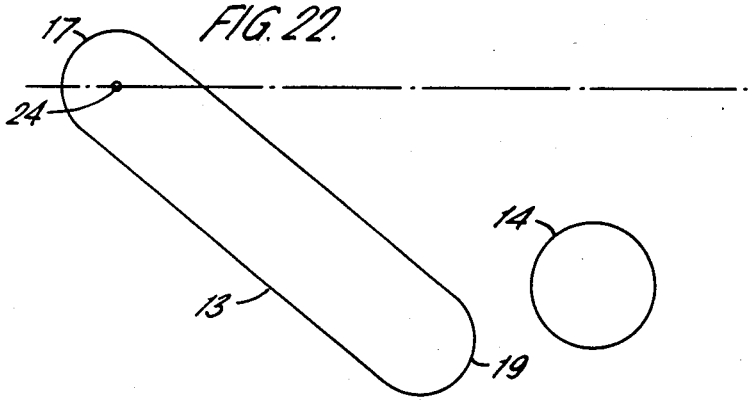

Reference is now made to FIG. 5 and to FIGS. 6 to 29 which illustrate collectively and individually respectively the path of movement and speed of the pin around the blade in steps equivalent to 15° of advance of the pin around the blade axis.

The blade 13 is oscillated through an arcuate path in the corner of a stack of sheets to be counted about an axis 24 at the centre of the radius of the leading edge of the blade by means of a mechanism to be described later. When the pin is in the position shown in FIG. 6, the pin is about to commence wiping the corner of one sheet adhered to the top surface of the blade from the upper side to the lower side and the blade has almost reached the horizontal position the pin accelerated in this phase of its movement to pass downwardly generally vertically close to the leading edge of the blade 13. At the same time the blade 13 continues to pivot upwardly until it reaches the full line position shown in FIG. 9 in which it is angled about three degress above the horizontal. By this time the sheet on the blade will have been wiped to the lower side of the blade and the suction port in the blade will adhere the next corner above to the blade. Meanwhile the rapidly accelerating pin moves downwardly below the level of the blade and then outwardly from the stack generally horizontally at high speed to reach the position of FIG. 18 in which the pin is clear of the trailing edge of the blade. As soon as the pin has cleared the trailing edge of the blade, the blade 13 drops rapidly down to the lower position indicated in FIG. 5 and drawing with it the corner of the sheet adhered to it. The pin then commences its movement into the stack at a relatively low speed over the upper surface of the downwardly inclined blade and as the pin moves over the upper surface of the blade, the blade starts to rise again until the pin reaches a position over the leading edge of the blade and the blade is almost in the horizontal position thus completing the cycle.

It will be seen from FIGS. 6 to 31 that the blade is in fact horizontally or approximately horizontally for some 180° of the cycle of the movement of the pin around the blade. This is achieved by swinging the blade downwardly as rapidly and as late as possible in its cycle of movement in relation to the pin and by returning the blade to the horizontal position as soon as possible in its cycle in relation to the pin. The blade is thus held in the horizontal position for as long as possible in the cycle to ensure a good suction grip on the sheet above.

It will also be noted that the pin moves closely adjacent the leading edge of the blade and it moves downwardly past the blade and the blade is held horizontally so that the pin can move outwardly from the stack in the horizontal direction. In this way deformation of the stack due to the action of the pin in the stack is minimised thus minimising damage to the corner of the sheets in the stack being counted.

Figure 1:
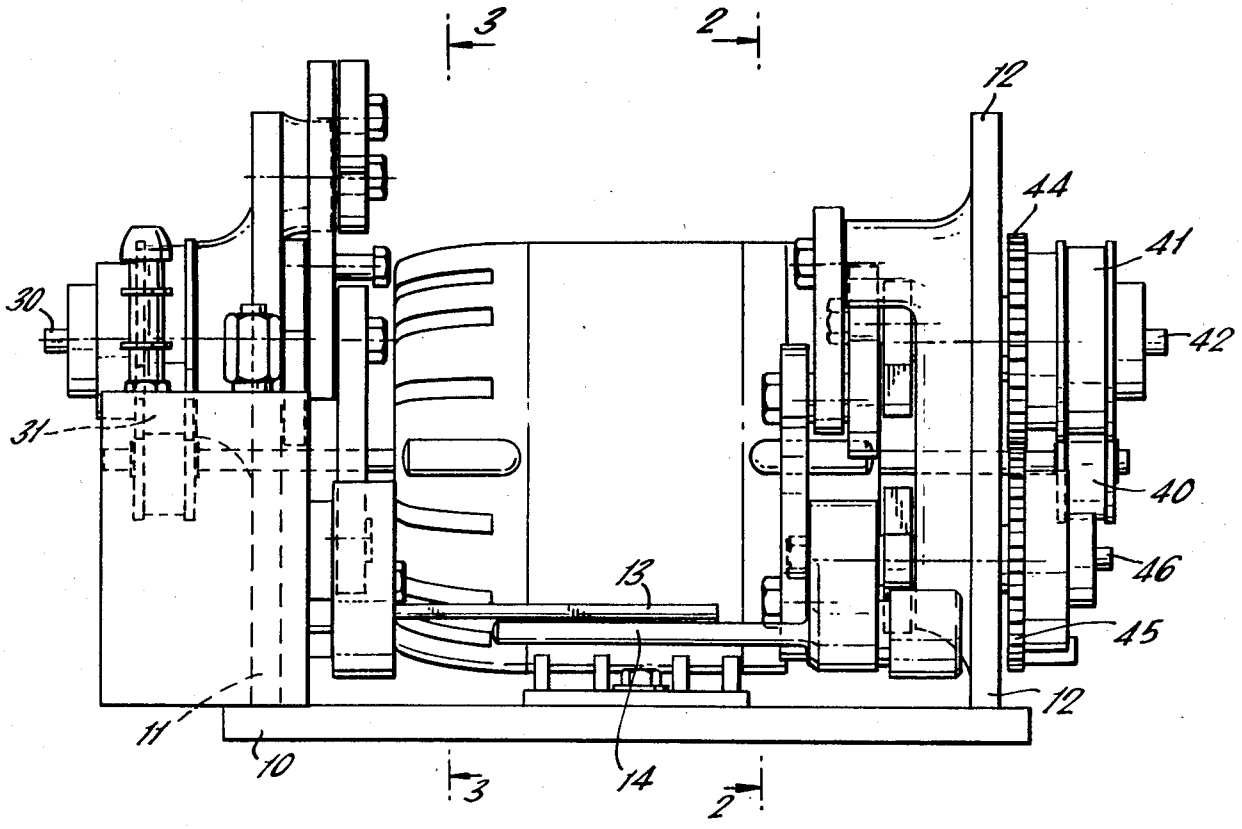
FIG. 1 is a front elevation view of a sheet separating device for a sheet stack counter.
Figure 23:
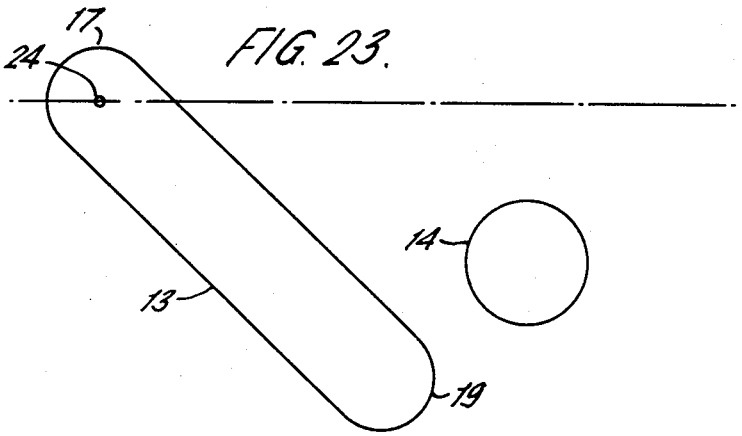
Figure 24:
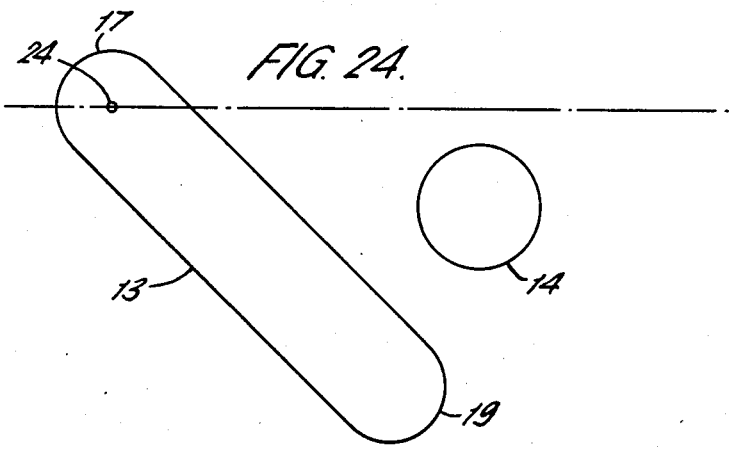
Figure 25:
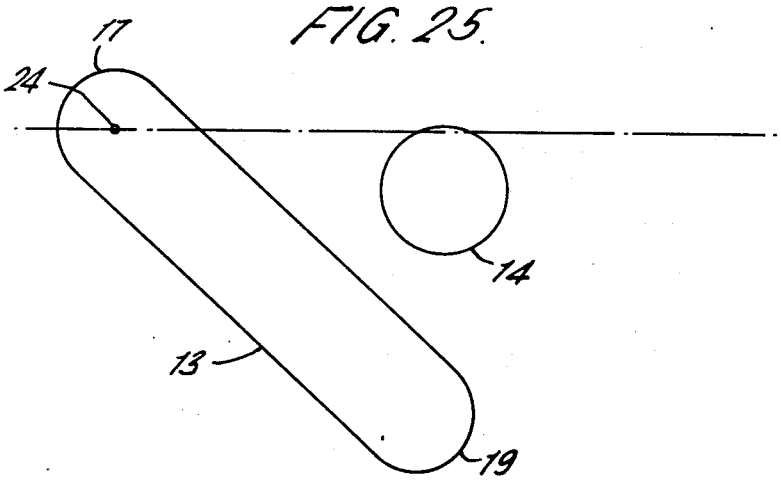
Figure 26:
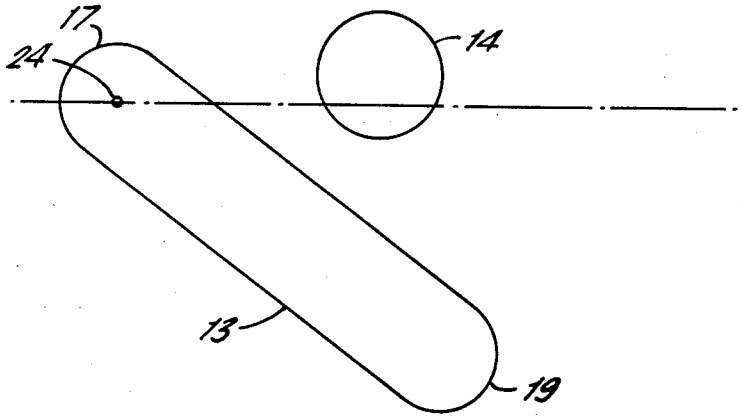
Figure 27:
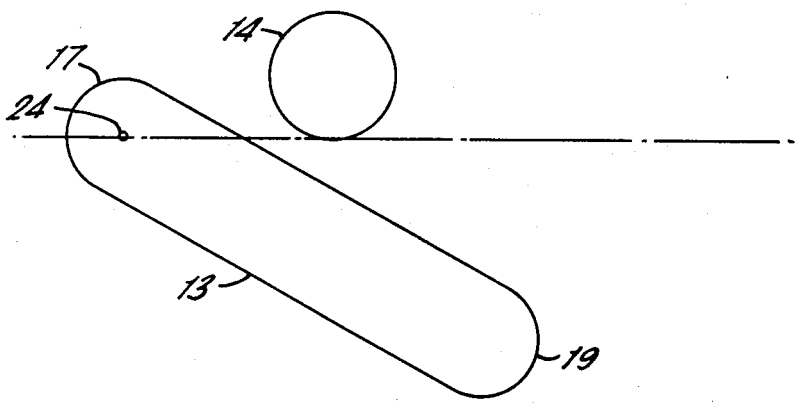
Figure 28:
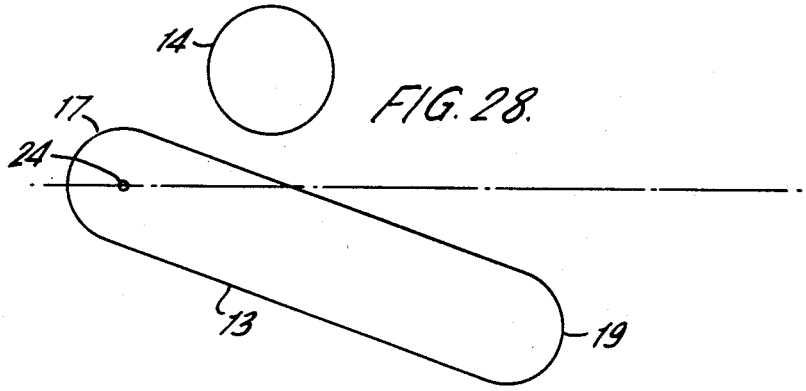
Figure 29:
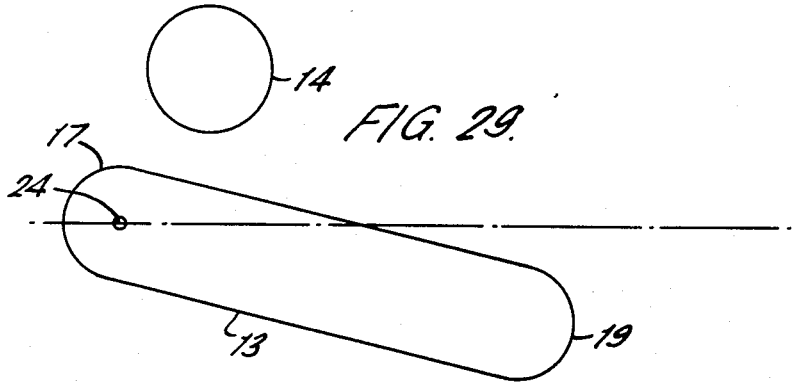

The actual counting of sheets takes place as the pin moves through the positions of FIGS. 23 and 24 and is effected by conventional counting mechanism. The mechanism for pivoting the blade 13 as described is best seen in FIG. 3 of the drawings to which reference will now be made. The drum 15 is pivotally mounted on a shaft 23 mounted for rotation in the side wall 11 about an axis of rotation indicated 24 which lies at the centre of the leading edge radius of the blade. The shaft 23 is oscillated by a crank arm 25 which is pivotally connected at one end of a link 26. The other end of the link 26 is pivotally connected to a further link 27 which is pivotally connected to a link 28, pivotally mounted at 29 on the wall 11. A crank shaft 30 (see FIGS. 1 and 2) is rotatably mounted on the wall 11 and is driven by a pulley 31 connected by a drive-belt 32 from an output pulley 33 on a drive-shaft 34 of an electric motor 35 mounted at the rear of the base 10. The crank shaft 30 carries, on the inside of the wall, an eccentric mounting pivot 37 connected to the aforesaid link 27. As the eccentric pivot 37 of the crank shaft 30 rotates, the linkage 25, 26, 27, 28 causes the blade 13 to pivot about the axis 24 as described and illustrated earlier.

The mechanism for moving the wiper pin 14 in synchronism with the blade 13 will now be described.

A further output pulley 40 on the motor shaft 34 drives a pulley 41 on the crank shaft 42 mounted on the wall 12 through an endless belt 43. The pulley 41 in addition to driving the crank shaft 42 also has a gear wheel 44 which meshes with a further gear wheel 45 on a further crank shaft 46 mounted on the wall 12. The contra-rotating crank shafts 42, and 46 have crank pins 49, 54 both disposed on the inner-side of the wall 12. The crank shaft eccentric pin 49 is connected by a link 50 via a common pivot **50*a* to a floating link 51; and, pivot 50*a* is also connected to further link 52 pivotally mounted at 53 on the wall 12. The eccentric pin 54 of crank-shaft 46 has one end of a lever 55 pivotally mounted thereto and the lower end of floating link 51 is pivotally connected at 56 partway along the lever 55. The outer end of the lever 55 carries the wiper pin 14. The crank drive mechanism for the pin and blade are constructed to cause the pin and blade to follow the paths of movement of the pin and blade indicated in FIGS. 5 to 29**.

We claim:

1. A sheet separating device for a sheet counting apparatus comprising, a horizontally extending blade having a leading edge for insertion in a corner of a stack of sheets and a trailing edge, means to rotate the blade between a substantially horizontal attitude and a position in which the blade is downwardly inclined towards the trailing edge thereof, suction means on the upper side of the blade to adhere a corner of a sheet to the upper side of the blade, and a wiper pin extending parallel to the blade having guided rotary means for moving the pin as the blade pivots between said horizontal attitude and said downwardly inclined position, around the blade over the upper side therefrom from the trailing edge to the leading edge, generally vertically downwardly past the leading edge of the blade and then along the underside of the blade to transfer a corner of a sheet adhered to the upper surface of the blade by said suction means to the lower surface, wherein the improvement comprises providing coordinating means for the pin moving means and the blade means so that during a first time interval the pin moving means moves the pin over the upper side of the blade from the trailing edge to the leading edge thereof, said blade rotating means being operable during said first time interval to rotate the blade from a downwardly inclined position to a substantially horizontal attitude, said blade remaining at said substantially horizontal attitude during a second time interval during which the pin moving means moves the pin beneath the blade from the leading edge to the trailing edge thereof, said blade rotating means being operable subsequent to said second time interval to rotate the blade into said downwardly inclined position, said pin moving means being operable during the second time interval to move the pin along the underside of the blade in a substantially horizontal direction close to the underside of the blade.

2. A sheet separating device as claimed in claim 1, wherein said moving means is arranged to vary the speed of the pin as it moves around the blade.

3. A sheet separating device as claimed in claim 2, wherein the pin moving means causes the pin to move at a first relatively slow speed as the pin moves into the stack over the blade and then causes the pin speed to increase for the path down the leading edge and underside of the blade.

4. A sheet separating device as claimed in claim 2 characterized in that the pin moving means causes the pin to remain stationary momentarily after the pin has cleared the underside to allow the blade to move downwardly before the pin moves over the upper side of the blade.

5. A sheet separating device as claimed in claim 1, wherein the blade rotating means cause the blade to remain horizontal for about 180° of the cycle of the pin as the pin moves down past the leading edge and along the underside of the blade.

6. A sheet separating device as claimed in claim 1, characterized in that the blade rotating means causes the blade to move downwardly to draw a corner of a sheet down relatively faster than its upward movement as the pin moves into the stack over its upper side.

7. A sheet separating device as claimed in claim 1, wherein the blade rotating means angles the blade upwardly at the trailing edge by about 3° in said generally horizontal position and angles the blade downwardly by about 45° in said downwardly tilted position.

8. A sheet separating device as claimed in claim 1, wherein the blade has a triangular shaped recess in its upper side, and a suction port is formed at the bottom of the recess.

9. A sheet separating device as claimed in claim 1, wherein means are provided to count each cycle of the pin to count the number of sheets passed by the pin.

10. A sheet separating device as claimed in claim 1, wherein the pin and blade are driven by respective rotary mechanisms operated by a common drive motor.

* * * * *